US010637148B1

(12) United States Patent
Channabasappa et al.

(10) Patent No.: US 10,637,148 B1
(45) Date of Patent: Apr. 28, 2020

(54) ANTENNA DESIGN FOR FULL DUPLEX COMMUNICATION WITH MULTIPLE WIRELESS COMMUNICATION PROTOCOL COEXISTENCE

(71) Applicant: Amazon Technologies, Inc., Seattle, WA (US)

(72) Inventors: Eswarappa Channabasappa, Milpitas, CA (US); Anuj Dron, San Jose, CA (US); Adrian Napoles, Gilroy, CA (US); Felipe Alonso Varela, San Jose, CA (US); Miguel Angel Morales, Santa Clara, CA (US)

(73) Assignee: Amazon Technologies, Inc., Seattle, WA (US)

( * ) Notice: Subject to any disclaimer, the term of this patent is extended or adjusted under 35 U.S.C. 154(b) by 142 days.

(21) Appl. No.: 15/874,481

(22) Filed: Jan. 18, 2018

(51) Int. Cl.

| | |
|---|---|
| ***H01Q 13/12*** | (2006.01) |
| ***H01Q 1/22*** | (2006.01) |
| ***H01Q 5/50*** | (2015.01) |
| ***H01Q 21/20*** | (2006.01) |

(52) U.S. Cl.
CPC ..... *H01Q 13/12* (2013.01); *H01Q 1/2291* (2013.01); *H01Q 5/50* (2015.01); *H01Q 21/20* (2013.01)

(58) Field of Classification Search
CPC .... H01Q 13/10; H01Q 13/103; H01Q 13/106; H01Q 13/12; H01Q 13/14; H01Q 13/18
See application file for complete search history.

(56) References Cited

U.S. PATENT DOCUMENTS

2003/0122722 A1* 7/2003 Sugiyama ..... H01Q 1/243 343/767
2017/0222326 A1* 8/2017 Wight ..... H01Q 13/16

* cited by examiner

*Primary Examiner* — Daniel Munoz
(74) *Attorney, Agent, or Firm* — Lowenstein Sandler LLP

(57) ABSTRACT

An apparatus includes a radio frequency (RF) feed and an extruded member made of metal and coupled to the RF feed. The extruded member includes a first surface that includes a first slot having a first width and a first length, and a second slot having a second width and a second length. The second width is at least 1.2 times greater than the first width. The second slot intersects the first slot at an angle with respect to the first slot that is between 70 and 110 degrees.

19 Claims, 8 Drawing Sheets

ANTENNA DESIGN FOR FULL DUPLEX COMMUNICATION WITH MULTIPLE WIRELESS COMMUNICATION PROTOCOL COEXISTENCE

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items.

In order to wirelessly communicate with other devices over a wireless local area network (WLAN), these electronic devices include one or more antennas, e.g., antennas radiated using WiFi™-based technology of the WiFi Alliance. Some electronic devices have been built that additionally wirelessly communicate with other devices over a wireless personal area network (WPAN) through one or more additional antennas using a different protocol that overlaps in frequency with the WiFi™ technology. Because of this overlap in frequency, coexistent and concurrent operation has not yet been achieved, forcing the use of time-division multiplexing, where the different protocol channels are often forced to wait while one more ore WiFi™ channels complete wireless transmission.

BRIEF DESCRIPTION OF THE DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1A:
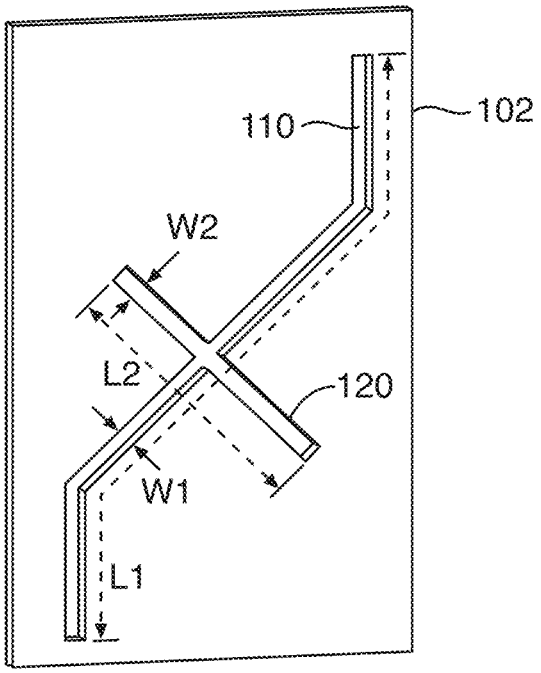
FIG. 1A is a plane view of a member including intersecting slots, according to one embodiment.

Some electronic devices have been built that additionally wirelessly communicate with other devices over a wireless personal area network (WPAN) through one or more additional antennas using a different protocol that overlaps in frequency with the WiFi™ technology, e.g., in the 2.4 GHz band. For example, the different protocol may be one or both of ZigBee of the Zigbee Alliance or Bluetooth® of the Bluetooth® Special Interest Group. Other protocols are envisioned that may also overlap in frequency with WiFi™ technology, whether in the 2.4 GHz band or the 5 GHz band. Because of this overlap in frequency, coexistent and concurrent operation has not yet been achieved, forcing the use of time-division multiplexing, where the different protocol channels are sometimes forced to wait while one more ore WiFi™ channels complete wireless transmission.

For example, antennas require high isolation for full-duplex coexistence between WiFi™ and Bluetooth® technologies in the same device. Additionally, if ZigBee technology is also coexistent with WiFi™ and Bluetooth® technologies, then the electronic device conventionally uses three-way multiplexing between respective radios for these three different protocols. As just one example, an electronic device does not know when it is going to receive wireless signals to open a ZigBee-based door lock associated with physical security of a building or home. But, a ZigBee radio is to keep a channel open to constantly listen for incoming ZigBee packets. Due to the use of time-division multiplexing, such an electronic device shuts down ZigBee-based signal detection when doing a WiFi™-based wireless transmission. In this example, the ZigBee-based door lock may need to send packets with several tries because the electronic device performing the detecting is busy with the WiFi™-based wireless transmission. As will be discussed in detail with relation to the disclosed extruded antenna designs, WiFi™-based transmissions may occur concurrently with coexistent ZigBee-based and Bluetooth®-based transmissions, due to the high isolation achieved between the disclosed antenna structures of different protocols. Accordingly, the ZigBee-based door lock may be detected without waiting.

Furthermore, antennas radiated with WiFi™-based signals are usually printed on the edges of a main circuit board of the electronic device, e.g., a main printed circuit board (PCB). The antenna performance depends on the antenna location on the circuit board, the location of copper layers on the circuit board, and on other powered structures situated within the electronic device. Such embedded antennas inside the structure may lead to radio frequency (RF) shadows in many parts of the home, e.g., areas of the home in which WiFi™-based signals are absent. This limitation on wireless signals within a home is a well-known phenomenon by consumers, who may deploy signal extenders and the like to deal with such RF shadows.

Additionally, antennas on a circuit board inside of the conventional electronic device may experience interference and noise from inside of the electronic device. As PCB-based printed antennas are close to several digital high frequency noise sources, this noise may couple to the printed antennas. Hence, RF desense may be too high, resulting in much degraded device receiver performance. This may also reduce the RF range and throughput of a digital signal.

Because of ever increasing user features in the devices, the power dissipation in conventional electronic devices has increased, resulting in larger heat spreading structures (e.g., heat spreaders or heat sinks) to effect the power dissipation. As these are mostly metallic, such heat spreaders affect the antenna performance of conventional devices. Furthermore, in devices that also incorporate audio speakers, better audio is often achieved with larger speakers. Such speakers may include, in part, metallic parts, a magnet, and also a large multi-turn coil. The coupling between these parts and the antennas has conventionally degraded wireless signal quality and throughput. The disclosed extruded antenna designs resolve these deficiencies as will be explained.

The disclosed antenna design may be an antenna assembly made of low-cost, structures formed from metal, which may, in one embodiment, be extruded metallic structures. The resonance and radiation mechanisms of each structure may be achieved by slot openings on first members (e.g., outer walls) of the structures and via chambers bounded by multiple connected members of the structures. The structures may be modular, and thus be adapted to fit multiple different electronic devices, or be deployed in different numbers to cover various portions of a perimeter of an electronic device. An inner cavity formed within the middle of the structures may be sized to receive a circuit board on which to dispose one or more WLAN radio and a transmission line coupled to the WLAN radio and to each structure. One or more WPAN radio and other circuitry for the electronic device may also be disposed on the circuit board. The cavity formed inside of the structures may also be sized to receive audio speakers or other powered structures of the electronic device.

Accordingly, in various embodiments, an apparatus or electronic device may include an RF feed and a structure coupled to the RF feed. The structure may include a first member defining slot openings that form a slot antenna. More specifically, the structure includes a first slot having a first width and a first length and a second slot having a second width and a second length. The second width may be at least 1.2 times greater than the first width, and may be as large as 1.6 times greater than the first width. The second slot may intersect the first slot at an angle with respect to the first slot that is between 70 and 110 degrees. In response to signals from the WLAN radio, the first slot may radiate electromagnetic energy in a first frequency range (e.g., in the 2.4 GHz band or some other band) and the second slot radiate electromagnetic energy at a second frequency range (e.g., in the 5 GHz band or some other band). The antenna assembly may include additional structures, e.g., with respect to a particular device design in terms of meeting specifications for WLAN wireless signal coverage, shielding of the parts on one or more circuit boards located within the cavity, and dual-use of the structures as heat spreaders.

According to various embodiments, the disclosed electronic device may further include at least one antenna carrier attached to one of a first end (or top) or a second end (or bottom) of the structure, and thus be positioned over or under the inner cavity, respectively. A patch antenna may be disposed on the antenna carrier and be coupled to the WPAN radio on the circuit board. In response to signals from the WPAN radio, the patch antenna may radiate electromagnetic energy in a third frequency range that overlaps, at least in part, with the first frequency range. In one embodiment, the patch antenna is a first patch antenna on a first antenna carrier attached to the first end of the antenna and the WPAN radio is a ZigBee-based radio.

According to another embodiment, the disclosed electronic device may further include a second antenna carrier attached to the second end of the structure. A second patch antenna may be disposed on the second antenna carrier and be coupled to a second WPAN radio that is disposed on the circuit board. In response to signals from the second WPAN radio, the second patch antenna may also radiate electromagnetic energy in a fourth frequency range that overlaps, at least in part, with the first frequency range. The second WPAN radio may be a Bluetooth®-based radio in this alternative embodiment. The positioning of the first antenna carrier and the second antenna carrier may be such that each patch antenna radiates electromagnetic energy out the first end or the second end of the electronic device, thus avoiding RF interference with the slotted antennas formed in the structures positioned along the sides the electronic device.

The disclosed electronic device, which incorporates one or more structures of an antenna assembly, may achieve high gain for the WLAN-radiated slot antennas incorporated in the outer surface of each structure, e.g., in being located at an outer perimeter of the electronic device and due to the extruded metallic design. Furthermore, the disclosed embodiments allow for a single PCB to feed the structures of the antenna assembly. If audio speakers are included within the bottom part of the cavity, for example, the metallic and other materials of the audio speakers may interfere little, if at all, with the outward radiation of electromagnetic energy from the slotted antennas on the outer sides of the structures. This facilitates the close physical placement of audio speakers in relation to the structures without unwanted noise, interference, or RF coupling. For a similar reason, coupling of high frequency noise from high-speed digital circuits on the circuit board, if present, is negligible. Hence, electronic devices incorporating the disclosed antenna structures and assemblies may have significantly reduced desense, with a corresponding improvement in RF data throughput and range.

FIG. 1A is a plane view of a structure 102 including intersecting slots, according to one embodiment. For example, the structure 102 (e.g., a flat metallic plate or sheet) may form or define a first slot 110 and a second slot 120 that intersects the first slot 110. The first slot 110 may have a first width (W1) and a first length (L1) and the second slot may have a second width (W2) and a second length (L2). The intersection of the first slot and the second slot may define an intersection location, which may be anywhere along the first length of the first slot 110 and/or anywhere along the second length of the second slot 120. In various embodiments, the second slot 120 intersects the first slot 110 at an angle with respect to the first slot 110 that is between 70 and 110 degrees. In one embodiment, the second slot 120 does not lay completely over the first slot 110. In another embodiment, the second slot 120 lays completely over the first slot 110. As illustrated, for example, the first slot 110 and second slot 120 form a cross-slot opening in which the first slot 110 is orthogonal to the second slot 120.

In various embodiments, the second width may be at least 1.2 times greater than the first width. In another embodiment, the second width is between 1.2 and 1.6 times the first width. For example, the first width may be 2 mm while the second width may be 3 mm. The first length of the first slot 110 may be approximately equal to a half wavelength at 2.45

GHz, and wherein the second length of the second slot 120 may be approximately equal to a half wavelength at 5.5 GHz, which is within the 5 GHz band of WiFi™.

In one embodiment, the structure 102 is elongated along a first axis, e.g., a vertical axis between a first end (or top) and a second end (or bottom) of the structure 102. While a first portion of the first slot 110 is slanted with respect to the first axis, the first slot 110 may also include a second portion at a first end of the first slot 110 and a third portion at a second end of the first slot. For example, the first portion of the first slot may intersect with the second slot, a second portion forms a first end at a second angle with respect to the first portion, and a third portion forms a second end at the second angle with respect to the first portion and that is parallel to the second portion.

In a related embodiment of the first slot 110, the second portion may be oriented along a second axis and the third portion oriented along a third axis, both of which are parallel to the first axis. In another embodiment, the second axis and third axis are parallel to each other, but form an angle with respect to the first axis. For example, one or both of the first slot 110 and the second slot 120 may be slanted with respect to the first axis at between a 20-degree and a 70-degree angle.

Figure 1B:
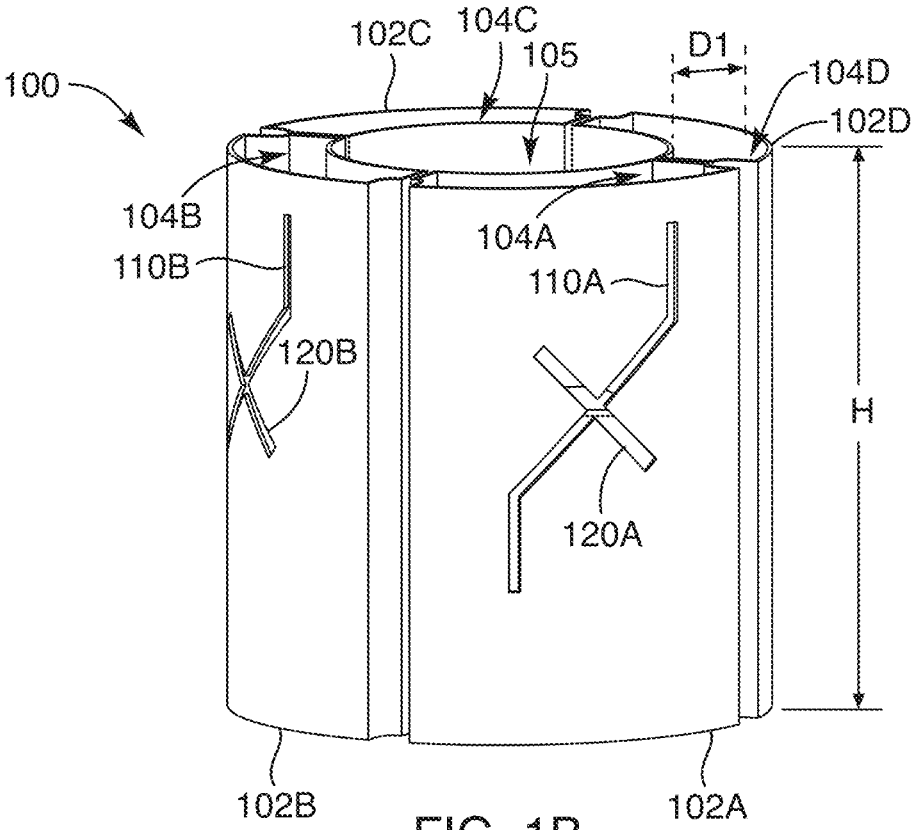
FIG. 1B is a perspective view an antenna assembly having multiple structure that include intersecting slots, according to another embodiment.

FIG. 1B is a perspective view an antenna assembly 100 having multiple structures that include intersecting slots, according to another embodiment. In this embodiment, antenna assembly 100 includes four structures 102A, 102B, 102C, and 102D, although fewer or more may also be employed as discussed. The structures may also be elongated along the first axis and form boundaries of an inner cavity 105 within a middle portion of the antenna assembly 100. As illustrated, the antenna assembly 100 has a cylindrical shape, and thus each structure is curved, but a rectangular shape and other shapes are also envisioned. For example, the first (or outer) member of each structure may be flat as is the structure 102 of FIG. 1A or the first member may be curved as illustrated in FIG. 1B.

Each of the structures may form similar intersecting slots as discussed with reference to FIG. 1A. For example, a first structure 102A may form, within the first member, a first slot 110A and a second slot 120A that intersects the first slot 110A and has dimensions such as those discussed with reference to the first slot 110 and the second slot 120 of the structure 102 of the antenna 100A (FIG. 1A). Furthermore, a second structure 102B may form, within its first member, a first slot 110B and a second slot 120B that intersects the first slot 110B and has dimensions such as those discussed with reference to the first slot 110 and the second slot 120 of the structure 102 of the antenna 100A (FIG. 1A). Each of a third structure 103A and a fourth structure 104A may be similarly shaped, although each structure and the slots that each defines may vary in shape and relative dimensions in some embodiments.

In various embodiments, the first member (e.g., outer member) of each metallic structure may be located a distance away (illustrated as D1) from a second member (e.g., an inner member), and include a third member and a fourth member, both connected to the first member and the second member to define a chamber 104A, 104B, 104C, and 104D, respectively, in each of the four structures 102A, 102B, 102C, and 102D. The second member of each structure may also partially bound the inner cavity 105, e.g., form the outer wall of the inner cavity 105. In one embodiment, D1 is between approximately 8 and 20 millimeters. Furthermore, the height (H) of each of the structures, and thus also of each chamber, may be between 20 and 60 millimeters longer than the first length of the first slot 110A or 110B. While the chambers 104A, 104B, 104C, and 104D each are illustrated as being empty, e.g., holding air, the chambers may also be filled with a dielectric material in alternative embodiments.

Figure 2A:
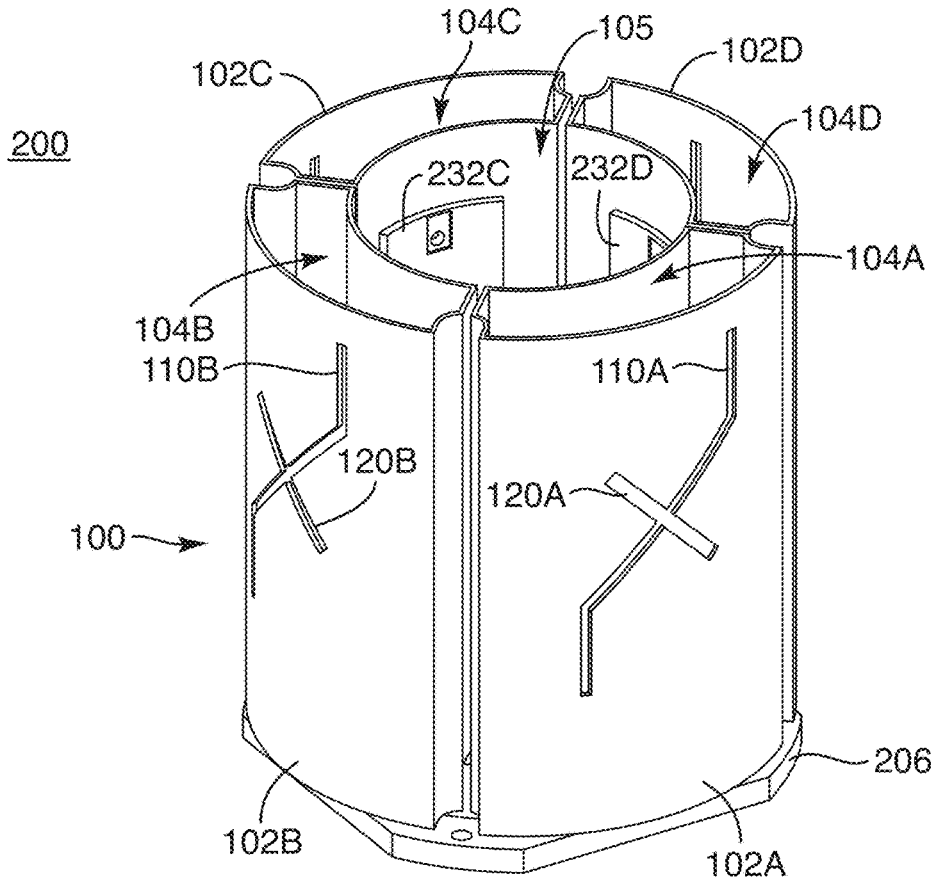
FIG. 2A is a perspective view of an electronic device that includes the assembly antenna of FIG. 1B, according to one embodiment.
Figure 2B:
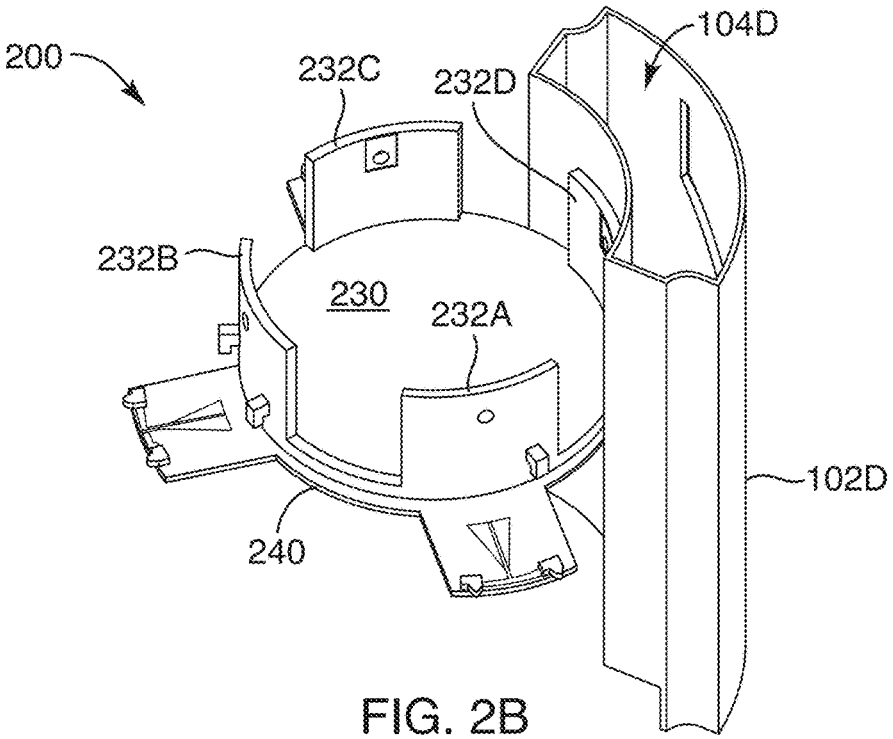
FIG. 2B is a perspective, partial view of the electronic device of FIG. 2A.
Figure 2C:
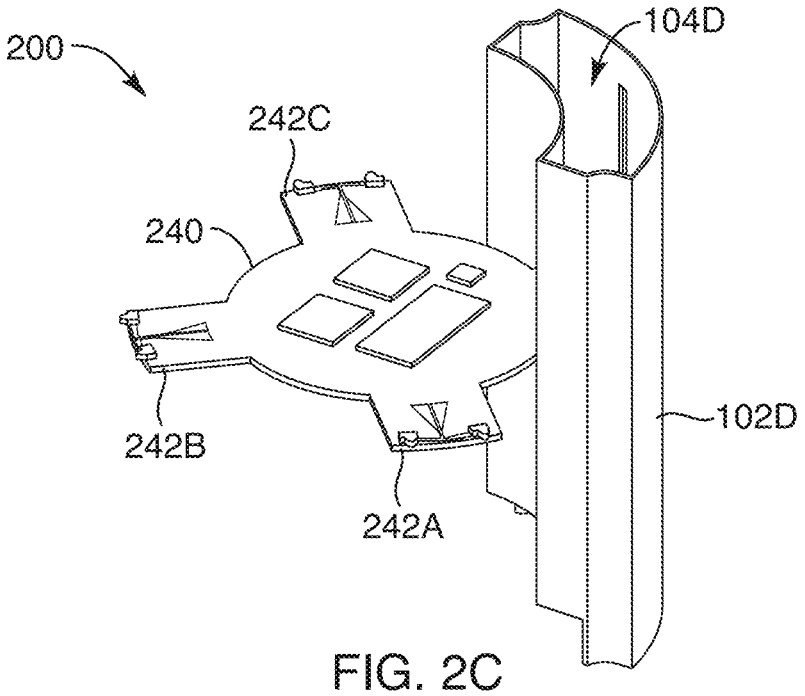
FIG. 2C is also a perspective, partial view of the electronic device of FIG. 2A.
Figure 2D:
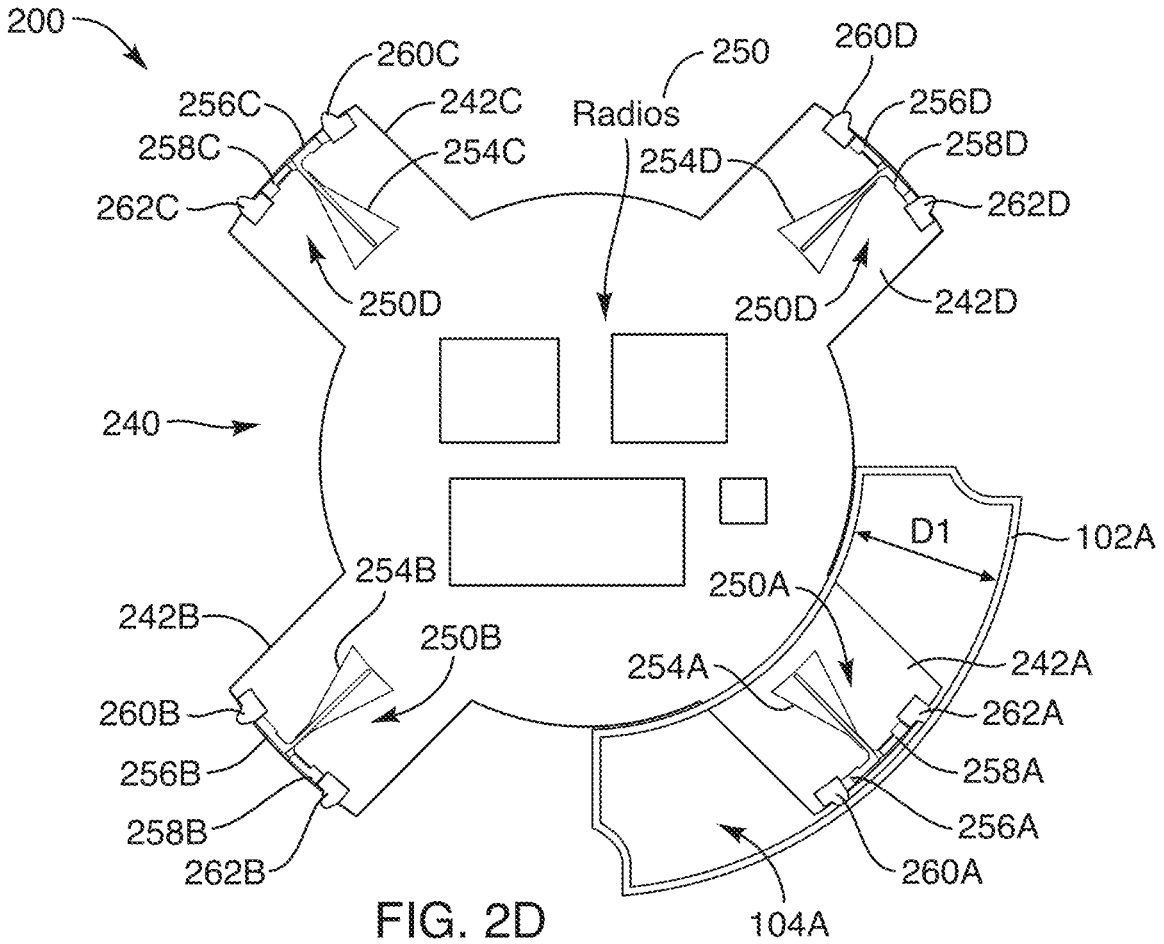
FIG. 2D is a plane view of the electronic device as illustrated in FIG. 2C.

FIG. 2A is a perspective view of an electronic device 200 that includes the antenna assembly 100 of FIG. 1B, according to one embodiment. FIG. 2B is a perspective, partial view of the electronic device 200 of FIG. 2A. FIG. 2C is also a perspective, partial view of the electronic device 200 of FIG. 2A. FIG. 2D is a plane view of the electronic device 200 as illustrated in FIG. 2C. In various embodiments, the electronic device 200, in addition to the features of the antenna assembly 100 discussed with reference to FIG. 1B, may include a speaker 206 or other powered electronics within, or at least partially within, a bottom of the inner cavity 105. Part of the speaker or other electronics may also extend to the outside of the antenna assembly 100 and thus also to the outside of the inner cavity 105. The electronic device 200 may further include a circuit board 204 on which may be disposed one or more radios 250, e.g., at least one WLAN radio that is based on WiFi™ technology, a first WPAN radio that is based on ZigBee technology, and at least a second WPAN radio that is based on Bluetooth® technology. Other radios for other communication protocols are envisioned. The circuit board 240 may be oriented in a second plane (e.g., a horizontal plane), and thus be generally perpendicular to the structures that are oriented in a first plane (e.g., in a vertical plane).

In some embodiments, the electronic device 200 may further include a heat spreader 230 attached to the top of the circuit board 240. The heat spreader 230 may include multiple flanges 232A, 232B, 232C, and 232D, where each flange may be aligned in parallel and attached to the first (or outer) member of a corresponding structure 102A, 102B, 102C, and 102D, respectively. The heat spreader 230 may aide in withdrawing heat from the circuitry and electronics disposed on the circuit board 140, to include the radios 250 and their transmission lines, and dissipate that heat throughout the surface area of the structures, thus providing a dual purpose for the structures, which are also to resonate and radiate electromagnetic energy in response to signals from the WLAN radio.

In various embodiments, the circuit board 240 further includes a first contact pad 242A, a second contact pad 242B, a third contact pad 242C, and a fourth contact pad 242D. The inner side of each structure 102A, 102B, 102C, and 102D may form an elongated opening to receive each respective contact pad 242A, 242B, 242C, and 242D. Each contact pad may include a balun coupled to a transmission line of the WLAN radio and a pair of pressure contacts attached to either of two conductors of the balun. The pair of pressure contacts, which may be, for example, spring contacts, may be brought into physical contact with a surface of the first member of a structure at the intersection location of the first slot and the second slot. A balun is a device that joins a balanced transmission line (one that has two conductors, with equal currents in opposite directions, such as a twisted pair cable) to an unbalanced transmission line (one that has just one conductor and a ground, such as a coaxial cable). Baluns may thus isolate a transmission line and provide a balanced output.

More specifically, the first contact pad 242A may include a first balun 250A including a first ground contact 254A, a first conductor 256A, and a second conductor 258A; a first pressure contact 260A coupled to the first conductor 256A of the first balun 250A; and a second pressure contact 262A coupled to the second conductor 258A of the first balun 250A. The second contact pad 242B may include a second balun 250B including a second ground contact 254B, a third conductor 256B, and a fourth conductor 258B; a third pressure contact 260B coupled to the third conductor 256B of the second balun 250B; and a fourth pressure contact 262B coupled to the fourth conductor 258B of the second balun 250B. The third contact pad 242C may include a third balun 250C including a third ground contact 254C, a fifth conductor 256C, and a sixth conductor 258C; a fifth pressure contact 260C coupled to the fifth conductor 256C of the third balun 250C; and a sixth pressure contact 262C coupled to the sixth conductor 258C of the third balun 250C. The fourth contact pad 242D may include a fourth balun 250D including a fourth ground contact 254D, a seventh conductor 256D, and an eighth conductor 258D; a seventh pressure contact 260D coupled to the seventh conductor 256D of the fourth balun 250D; and an eighth pressure contact 262D coupled to the eighth conductor 258D of the fourth balun 250D.

In one embodiment, the first pressure contact 260A and the second pressure contact 262A are separated by between four and six millimeters, so that their contact with an inner surface of the first member of the first structure is not too far to either side of the intersection location of the first and second slots 110A and 120A. For example, the first pressure contact 260A may be attached to an edge of the first contact pad 242A and may physically contact the first member at a first side of the intersection location. The second pressure contact 262A may be attached to the edge of the first contact pad 242A at a location distanced from the first pressure contact 260A (e.g., by 4-6 mm) and may physically contact the first member at a second side of the intersection location of the first and second slots 110A and 120A. Each of the second contact pad 242B, the third contact pad 242C, and the fourth contact pad 242D may be similarly arranged with a balun and a pair of pressure contacts. In this way, extensive use of coaxial cable may be avoided, which saves on cost, and the RF feeds to the antenna assembly 100 may be provided by way of pressure contacts directly off the edge of the circuit board 140. In alternative embodiments, the transmission line from the WLAN radio may be provided by coaxial cable, which is split at the end to form attachment points to the inner surface.

Figure 3A:
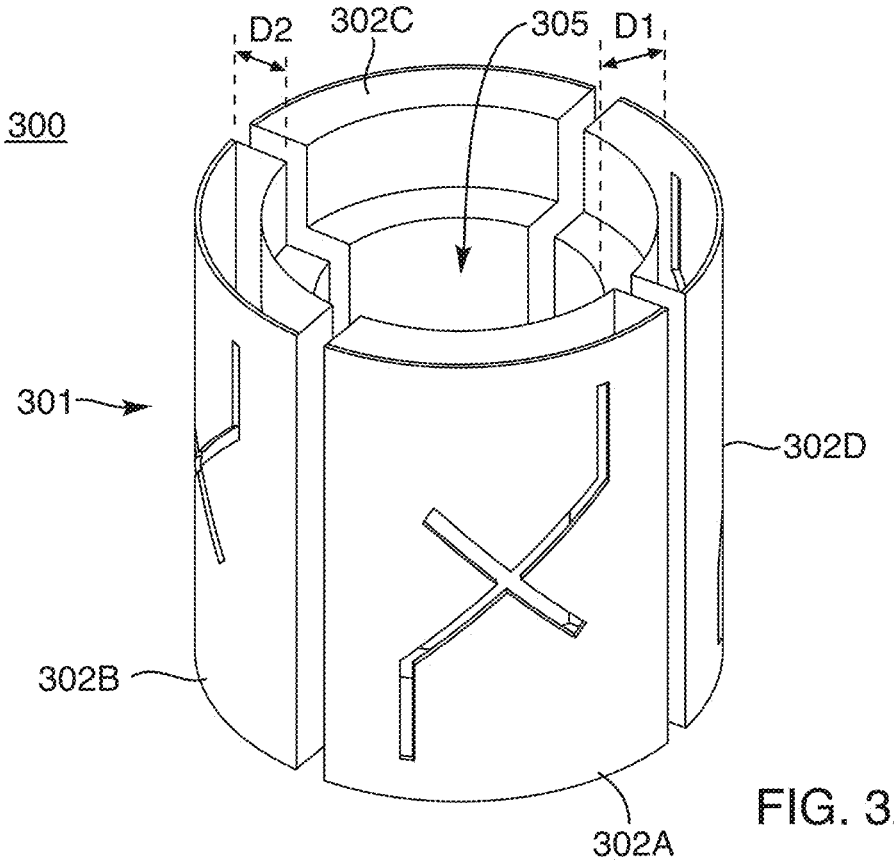
FIG. 3A is a perspective view of an electronic device having an extruded antenna with an enlarged inner cavity, according to another embodiment.
Figure 3B:
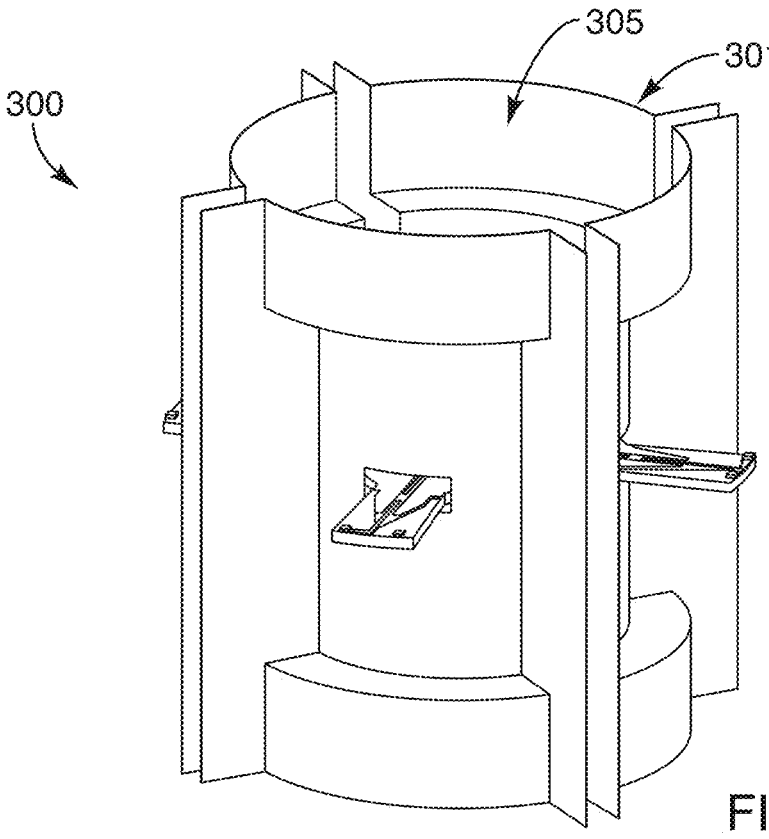
FIG. 3B is a perspective, partial view of the electronic device of FIG. 3A.

FIG. 3A is a perspective view of an electronic device 300 having an antenna assembly 301 with an enlarged inner cavity 305, according to another embodiment. FIG. 3B is a perspective, partial view of the electronic device 300 of FIG. 3A. In one embodiment, the antenna assembly 301 may be similar to the antenna assembly 100 discussed previously, e.g., include a first structure 302A, a second structure 302B, a third structure 302C, and a fourth structure 302D. These structures, which may be extruded metal pieces, may define the enlarged inner cavity 305, which cavity may be enlarged in at least a top portion and/or a bottom portion of the inner cavity, where a speaker or other powered component or additional heat sink may be housed. As a result of the enlarged inner cavity, the top portion and/or the bottom portion of each structure may have a chamber of reduced thickness, e.g., the distance between the outer side and the inner side of each structure may be a second distance (D2) that is shorter than the first distance (D1) (FIG. 1B).

Figure 4A:
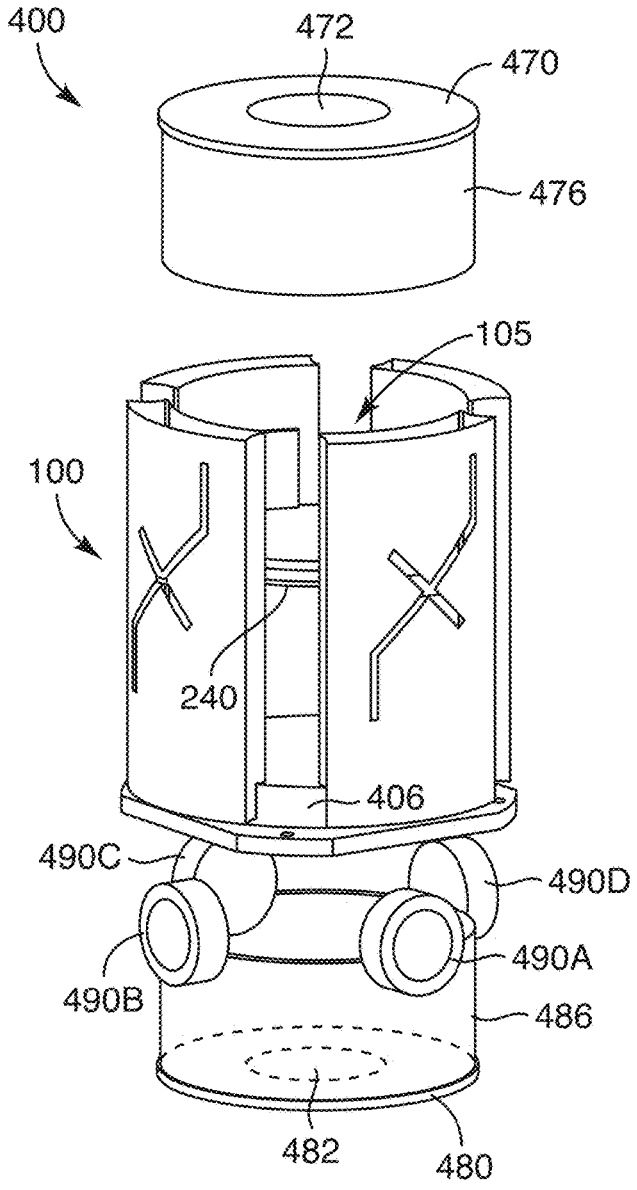
FIG. 4A is an exploded view of an electronic device having an antenna assembly with a pair of patch antennas to radiate at an overlapping frequency to that of structures of the antenna assembly, according to one embodiment.

FIG. 4A is an exploded view of an electronic device having the antenna assembly 100 with a pair of patch antennas to radiate at an overlapping frequency to that of the multiple structures of the antenna assembly 100, according to one embodiment. The electronic device 400 may be similar to the electronic device 200 of FIGS. 2A-2D, and further include a large speaker 406 housed inside a bottom portion of the inner cavity 105.

In various embodiments, the electronic device 400 may further include a first antenna carrier 470 (which may be a PCB in one example) on which is disposed a first patch antenna 472. A first attachment member 476 may be attached to the first antenna carrier 470 and be insertable into the inner cavity 105, such that the first patch antenna 472 is oriented generally above the inner cavity. Other means of attachment such as use of brackets and fasteners is also envisioned. A first WPAN radio (such as a ZigBee radio) may be coupled to the first patch antenna 472, which may, in response to signals from the first WPAN radio, radiate electromagnetic energy in a third frequency range that overlaps, at least in part, with one of the first frequency range (e.g., within the 2.4 GHz band) or the second frequency range (e.g., within the 5 GHz band). The first patch antenna 472 may be oriented in the horizontal plane and thus radiate upwards and away from the antenna assembly 100.

The electronic device 400 may further include a second antenna carrier 480 (which may be a PCB in one example) on which is disposed a second patch antenna 482. A second attachment member 486 may be attached to the second antenna carrier 480 and be insertable into the inner cavity 105, such that the second patch antenna 482 is oriented generally below the inner cavity. Other means of attachment such as use of brackets and fasteners is also envisioned. A first WPAN radio (such as a Bluetooth® radio) may be coupled to the first patch antenna 472, which may, in response to signals from the second WPAN radio, radiate electromagnetic energy in a fourth frequency range that overlaps, at least in part, with one of the first frequency range (e.g., within the 2.4 GHz band) or the second frequency range (e.g., within the 5 GHz band). The first patch antenna 482 may be oriented in the horizontal plane and thus radiate downwards and away from the antenna assembly 100.

In a further embodiment, a set of tweeter speakers 490A, 490B, 490C, and 490D may be positioned within the inner cavity 105 of the antenna assembly 100. Alternatively, other electronic components may be placed in the inner cavity or outer chambers.

Figure 4B:
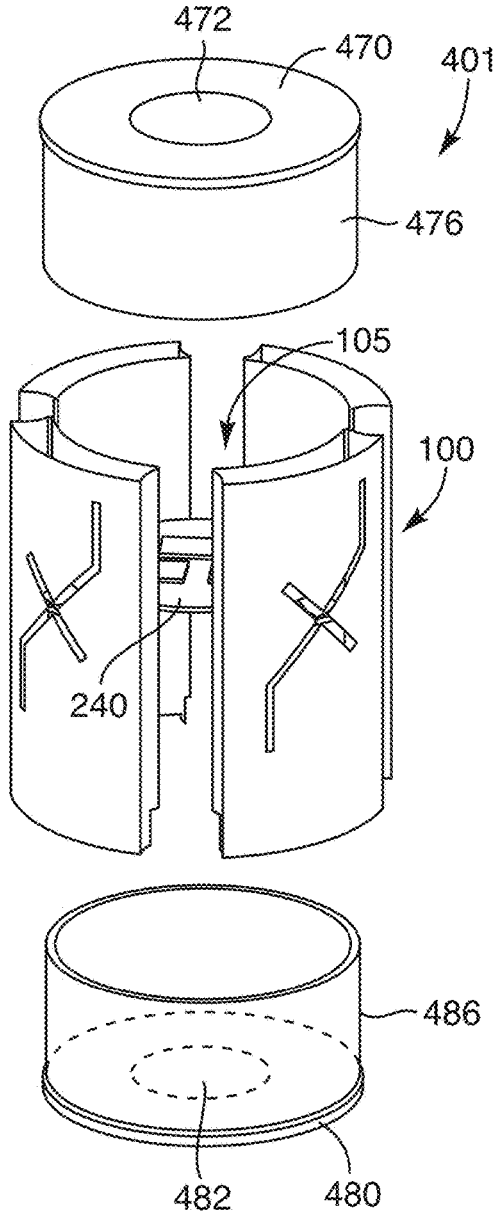
FIG. 4B is an exploded view of an electronic device having an antenna assembly with a pair of patch antennas to radiate at an overlapping frequency to that of structures of the antenna assembly, according to another embodiment.

FIG. 4B is an exploded view of an electronic device having the antenna assembly 100 with a pair of patch antennas to radiate at an overlapping frequency to that of structures of the antenna assembly 100, according to another embodiment. In various embodiments, the electronic device 401 of FIG. 4B may exclude the speakers or additional electronic components disclosed with reference to the electronic device 400 of FIG. 4A. Here, the first and second antenna carriers 470 and 480 and corresponding first and second patch antennas 472 and 482 may be employed as previous disclosed with reference to FIG. 4A.

Figure 5:
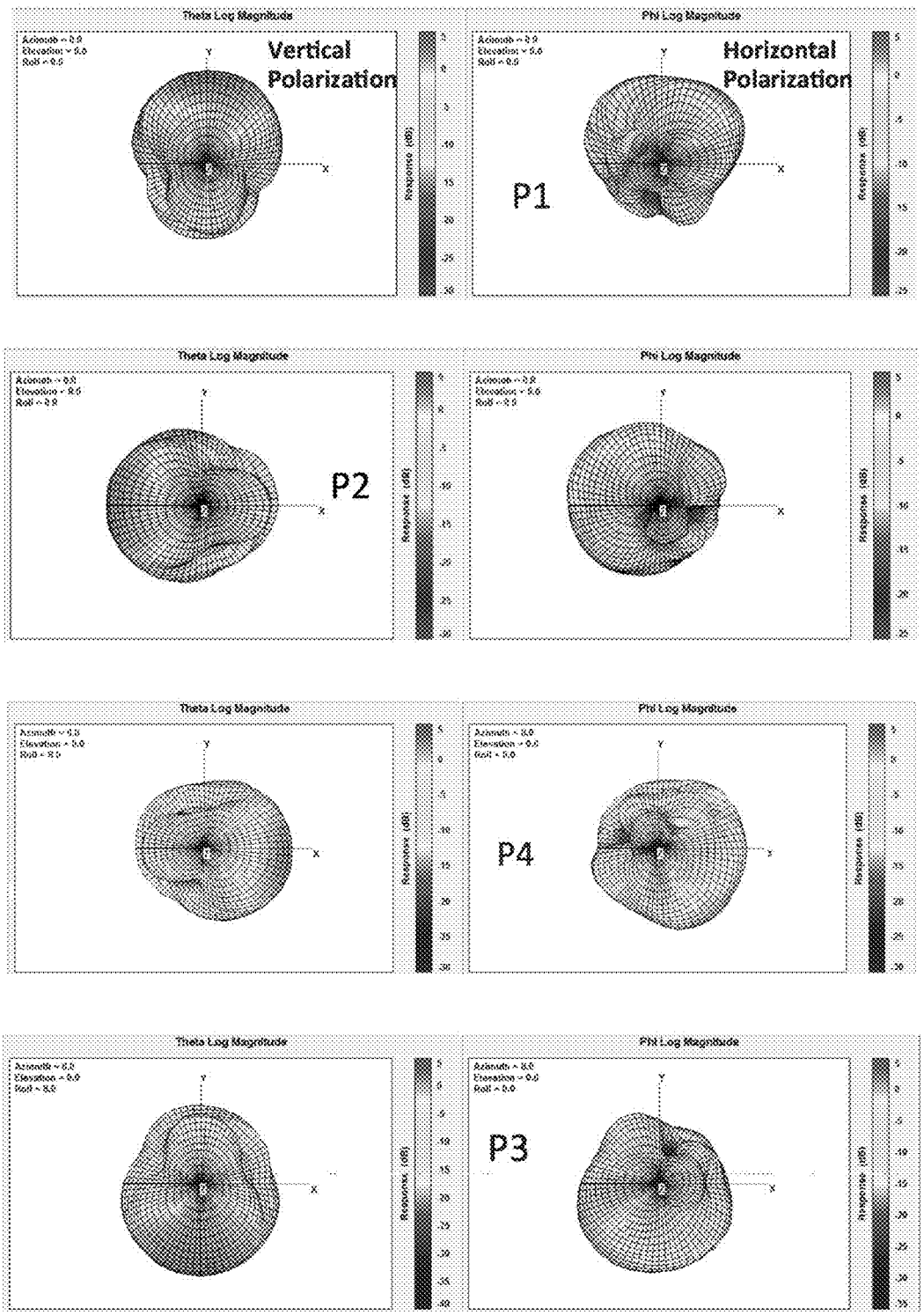
FIG. 5 illustrates polarization graphs illustrating measured radiation of an antenna assembly at 2450 MHz.

FIG. 5 illustrates polarization graphs illustrating measured radiation of the antenna assembly 100 at 2450 MHz. The left-most graphs illustrate vertical polarization of the electromagnetic energy radiation from the antenna assembly 100. The right-most graphs illustrate horizontal polarization from the antenna assembly 100. Furthermore, the P1 relates to a port connected to the first structure 102A, P2 relates to a port connected to the second structure 102B, P3 relates to a port connected to the third structure 102C, and P4 relates to a port connected to the fourth structure 102D of the antenna assembly 100 (FIGS. 1B, 2A). Accordingly, design of the cross-slot openings from the intersected first slot 110 and second slot 120 may produce cross-polarization at 2450 MHz.

Figure 6:
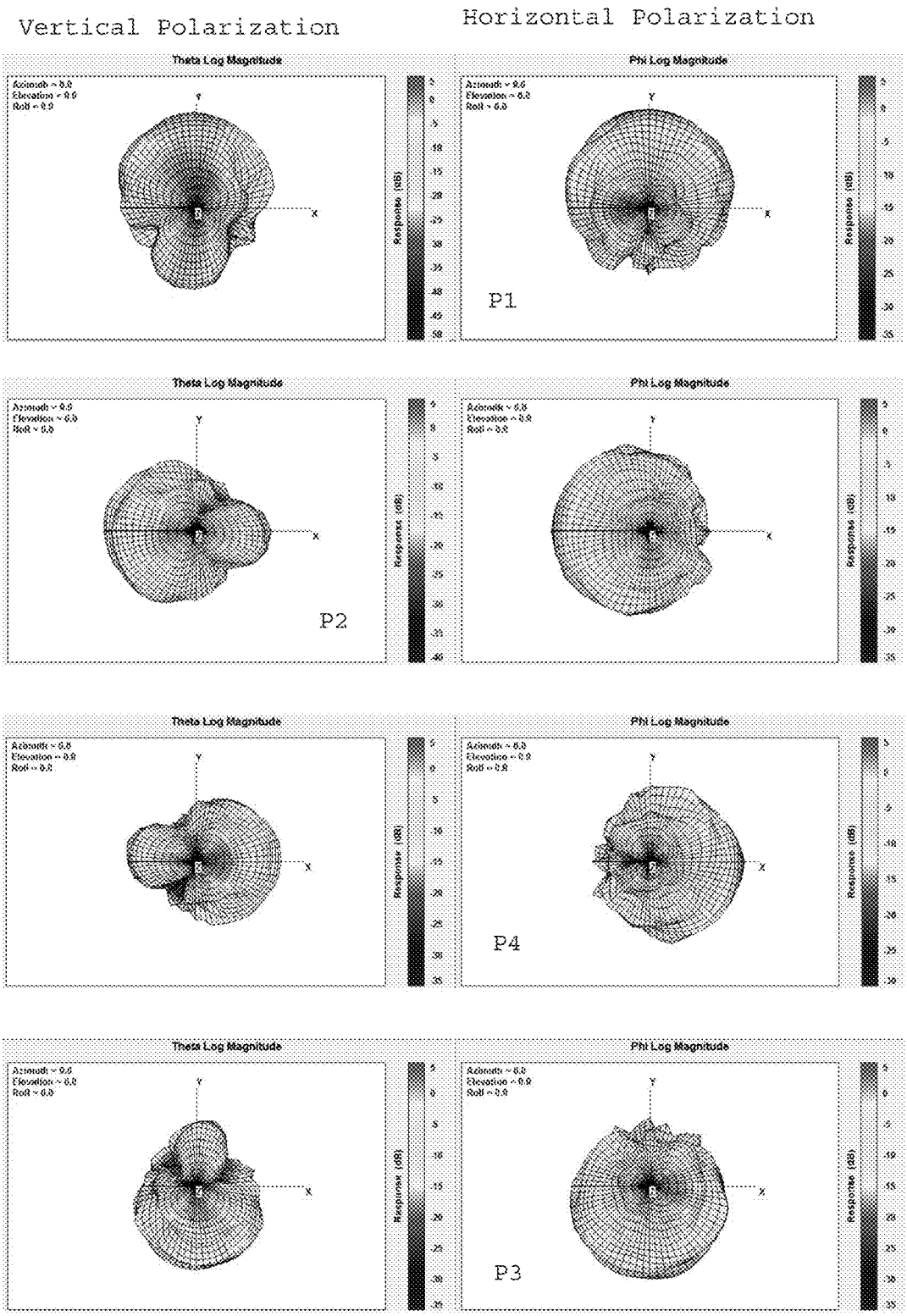
FIG. 6 illustrates polarization graphs illustrating measured radiation of an antenna assembly at 5200 MHz.

FIG. 6 illustrates polarization graphs illustrating measured radiation of the antenna assembly 100 at 5200 MHz. FIG. 6 illustrate similar graphs for vertical polarization and horizontal polarization radiation patterns at a radiation frequency of 5200 MHz, with the P1, P2, P3, and P4 corresponding to the first structure 102A, second structure 102B, third structure 102C, and fourth structure 102D, as with reference to FIG. 5.

In various embodiments, a microcontroller may also be included on the circuit board 240 and be coupled to respective RF feeds or transmission lines going to each structure 102A, 102B, 102C, and 102D. The microcontroller may switch levels of power to emphasize radiation of electromagnetic energy from individual structures of the multiple structures, e.g., within certain sectors of the outer perimeter of the antenna assembly 100. This selective power radiation out of the multiple structures may be performed akin to beam forming based on radio frequency (RF) transmission indicators in received signals by the multiple structures, or according to user programming in terms of which sectors of the antenna assembly 100 are to be emphasized in terms of RF coverage. The RF transmission indicators may be, for example, received signal strength indicator (RSSI), signal-to-noise ratio, throughput, bit error rate (BER), or the like, which may indicate which sectors are performing better than other sectors. The microcontroller may then shift power into those best-performing sectors. In this way, an electronic device incorporating the antenna assembly 100 that is located in a corner or in a confined space may be customized for the environment in which it is deployed.

Further to the above-discussed figures, an electronic device according to an embodiment may include the circuit board 240 on which is disposed a wireless local area network (WLAN) radio and a wireless personal area network (WPAN) radio. The antenna assembly 100 may be coupled to the WLAN radio and include a plurality of structures (e.g., at least two of 102A, 102B, 102C, and 102D) that form the inner cavity 105 or 305 in which is located the circuit board 240. In one embodiment, the plurality of structures includes at least the first structure 102A and a second structure (e.g., any one of structures 102B, 102C, or 102D).

The first structure may be made of metal and include a first member and an opposing second member, wherein the second member partially bounds the inner cavity. The first structure may further include a third member and a fourth member, both connected to the first member and the second member to define a first chamber, wherein the first member includes a first slot antenna. The first slot antenna may include a first slot and a second slot that intersects the first slot at a first intersection location, the first slot having a first width and the second slot having a second width that is greater than the first width. A first transmission line of the WLAN radio may be coupled to the first slot antenna at the first intersection location, and in response to signals from the WLAN radio, the first slot may radiate electromagnetic energy in a first frequency range and the second slot may radiate electromagnetic energy in a second frequency range.

The second structure may be made of metal, and include a fifth member and an opposing sixth member, wherein the sixth member partially bounds the inner cavity. The second structure may further include a seventh member and an eighth member, both connected to the fifth member and the sixth member to define a second chamber, wherein the fifth member includes a second slot antenna. The second slot antenna may include a third slot and a fourth slot that intersects the third slot at a second intersection location, the third slot having the first width and the second slot having the second width. A second transmission line of the WLAN radio may be coupled to the second slot antenna at the second intersection location, and in response to signals from the WLAN radio, the third slot may radiate electromagnetic energy in the first frequency range and the fourth slot may radiate electromagnetic energy in the second frequency.

The electronic device may further include a first antenna carrier attached to one of a first end or a second end of the antenna assembly, and positioned over or under the inner cavity, respectively. A first patch antenna may be disposed on the first antenna carrier and coupled to the WPAN radio, wherein in response to signals from the WPAN radio, the first patch antenna is to radiate electromagnetic energy in a third frequency range that overlaps, at least in part, with the first frequency range.

In a further embodiment, the first antenna carrier is attached to the first end of the antenna assembly, and the electronic device further includes a second WPAN radio disposed on the circuit board. A second antenna carrier may be attached to the second end of the antenna assembly. A second patch antenna may be disposed on the second antenna carrier and coupled to the second WPAN radio, wherein, in response to signals from the second WPAN radio, the second patch antenna is to radiate electromagnetic energy in approximately the first frequency range.

In a still further embodiment, the circuit board 240 may include a first contact pad extending through an opening in an inner side of the four elongated sides of the first structure. A balun may be disposed on the circuit board and coupled to the first transmission line, wherein the balun includes a first conductor and a second conductor. A first pressure contact may be coupled to the first conductor, the first pressure contact positioned on an edge of the first contact pad and in physical contact with the first member at a first side of the first intersection location. A second pressure contact may be coupled to the second conductor, the second pressure contact positioned on the edge of the first contact pad at a location distanced from the first pressure contact and in physical contact with the first member at a second side of the intersection location. These features may be added to or subtracted from within the scope of the presently disclosed embodiments.

Figure 7:
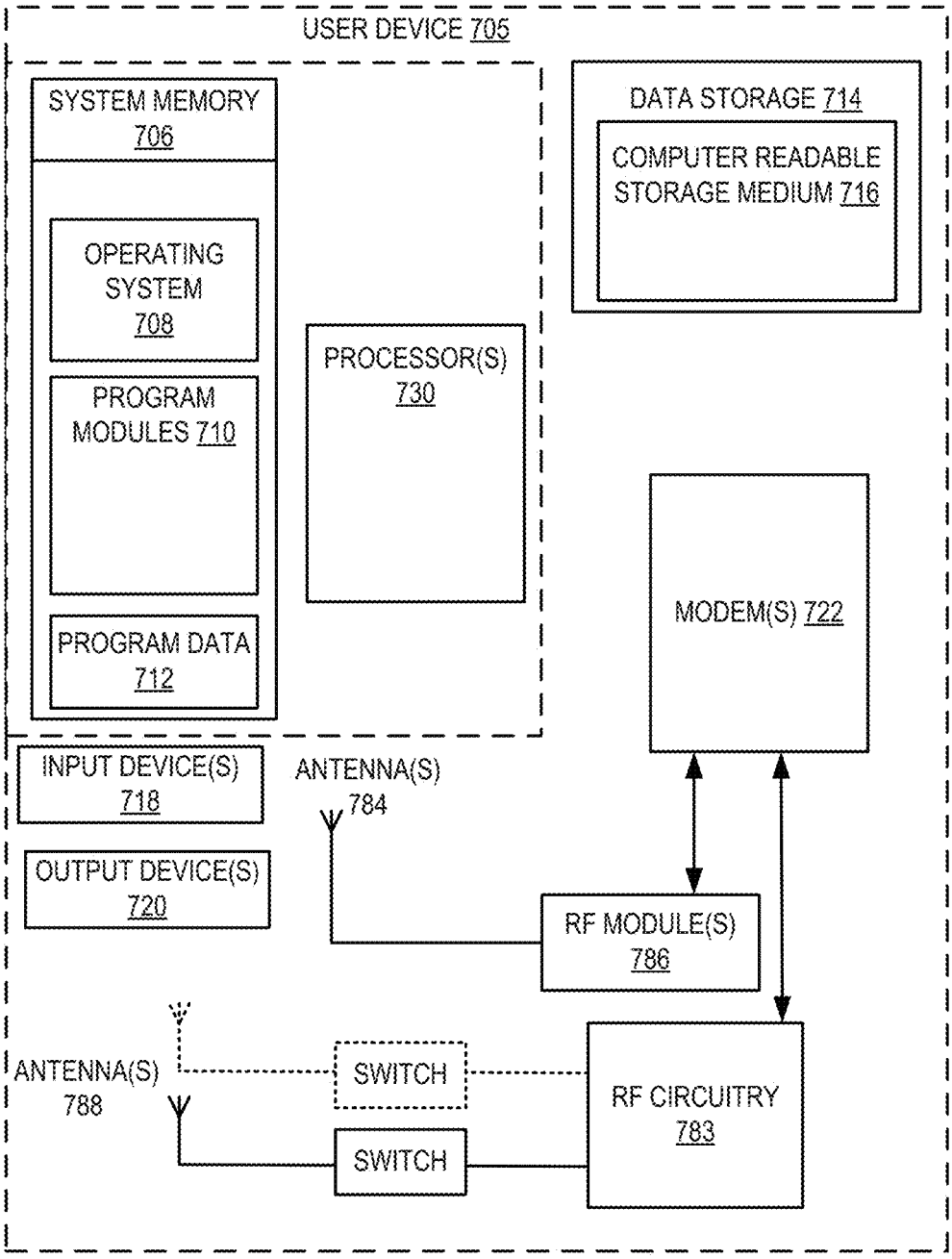
FIG. 7 is a block diagram of a user device in which embodiments of the antenna assembly and the different patch antennas may be employed.

FIG. 7 is a block diagram of a user device 705 in which embodiments of the antenna assembly 100 and the different patch antennas 472 and 482 may be employed. The user device 705 may be any type of computing device such as an electronic book reader, a PDA, a mobile phone, a laptop computer, a portable media player, a tablet computer, a camera, a video camera, a netbook, a desktop computer, a gaming console, a DVD player, a computing pad, a media center, a home security system, a home automation system, or combination thereof. The user device 705 may be any portable or stationary user device. For example, the user device 705 may be an intelligent voice control and speaker system. Alternatively, the user device 705 may be any other device used in a WLAN network (e.g., Wi-Fi® network), a PAN network, a WAN network, or a combination thereof.

The user device 705 includes one or more processor(s) 730, such as one or more CPUs, microcontrollers, field programmable gate arrays, or other types of processors. The user device 705 also includes system memory 706, which may correspond to any combination of volatile and/or non-volatile storage mechanisms. The system memory 706 stores information that provides operating system component 708, various program modules 710, program data 712, and/or other components. In one embodiment, the system memory 706 stores instructions of the disclosed methods. The user device 705 performs functions by using the processor(s) 730 to execute instructions provided by the system memory 706.

The user device 705 also includes a data storage device 714 that may be composed of one or more types of removable storage and/or one or more types of non-removable storage. The data storage device 714 includes a computer-readable storage medium 716 on which is stored one or more sets of instructions embodying any of the methodologies or functions described herein. Instructions for the program modules 710 may reside, completely or at least partially, within the computer-readable storage medium 716, system memory 706 and/or within the processor(s) 730 during execution thereof by the user device 705, the system memory 706 and the processor(s) 730 also constituting computer-readable media. The user device 705 may also include one or more input devices 718 (keyboard, mouse device, specialized selection keys, etc.) and one or more output devices 720 (displays, printers, audio output mechanisms, etc.).

The user device 705 further includes a modem 722 to allow the user device 705 to communicate via a wireless network (e.g., such as provided by the wireless communication system) with other computing devices, such as remote computers, an item providing system, and so forth. The modem 722 may be connected to RF circuitry 783 and zero or more RF modules 786. The RF circuitry 783 may be a WLAN module, a WAN module, PAN module, or the like. Antennas 788 are coupled to the RF circuitry 783, which is coupled to the modem 722. Zero or more antennas 784 may be coupled to one or more RF modules 786, which are also connected to the modem 722. The zero or more antennas 784 may be GPS antennas, NFC antennas, other WAN antennas, WLAN or PAN antennas, or the like. The modem 722 allows the user device 705 to handle both voice and non-voice communications (such as communications for text messages, multimedia messages, media downloads, web browsing, etc.) with a wireless communication system. The modem 722 may provide network connectivity using various types of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed down-link packet access (HSDPA), Wi-Fi®, Long Term Evolution (LTE) and LTE Advanced (sometimes generally referred to as 4G), etc., although not all of these mobile network technologies may be available.

The modem 722 may generate signals and send these signals to antenna(s) 788 via RF circuitry 783 and to the antenna(s) 784 via the RF module(s) 786, as descried herein. User device 705 may additionally include a WLAN module, a GPS receiver, a PAN transceiver and/or other RF modules. These RF modules may additionally or alternatively be connected to one or more of antennas 784, 788. Antennas 784, 788 may be configured to transmit in different frequency bands and/or using different wireless communication protocols. The antennas 784, 788 may be directional, omnidirectional, or non-directional antennas. In addition to sending data, antennas 784, 788 may also receive data, which is sent to appropriate RF modules connected to the antennas.

In one embodiment, the user device 705 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna building that operates at a first frequency band and the second wireless connection is associated with a second resonant mode of the antenna building that operates at a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a modem 722 is shown to control transmission and reception via antenna (784, 788), the user device 705 may alternatively include multiple modems, each of which is configured to transmit/receive data via a different antenna and/or wireless transmission protocol.

The user device 705 delivers and/or receives items, upgrades, and/or other information via the network. For example, the user device 705 may download or receive items from an item providing system. The item providing system receives various requests, instructions and other data from the user device 705 via the network. The item providing system may include one or more machines (e.g., one or more server computer systems, routers, gateways, etc.) that have processing and storage capabilities to provide the above functionality. Communication between the item providing system and the user device 705 may be enabled via any communication infrastructure. One example of such an infrastructure includes a combination of a wide area network (WAN) and wireless infrastructure, which allows a user to use the user device 705 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots may be created by Wi-Fi® products based on IEEE 802.11x standards by Wi-Fi Alliance. Another of the wireless communication systems may be a wireless carrier system that may be implemented using various data processing equipment, communication towers, etc. Alternatively, or in addition, the wireless carrier system may rely on satellite technology to exchange information with the user device 705.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 705 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 705 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known buildings and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required building for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An apparatus comprising:

a radio frequency (RF) feed; and a structure made of metal and coupled to the RF feed, wherein the structure includes a first member including a plurality of slots, the plurality of slots comprising:

a first slot having a first width and a first length; and a second slot having a second width and a second length, wherein the second width is between 1.2 and 1.6 times greater than the first width, and wherein the second slot intersects the first slot at an angle with respect to the first slot that is between 70 and 110 degrees.

2. The apparatus of claim 1, further comprising:

a circuit board;

a wireless local area network (WLAN) radio disposed on the circuit board and coupled to the RF feed, wherein in response to signals from the WLAN radio, the first slot is to radiate electromagnetic energy in a first frequency range and the second slot is to radiate electromagnetic energy in a second frequency range;

a wireless personal area network (WPAN) radio disposed on the circuit board;

an antenna carrier attached to the structure; and a patch antenna disposed on the antenna carrier and coupled to the WPAN radio, wherein the patch antenna, in response to signals from the WPAN radio, is to radiate electromagnetic energy in a third frequency range that overlaps, at least in part, with the first frequency range.

3. The apparatus of claim 1, wherein the first member is curved.

4. The apparatus of claim 1, wherein the first length of the first slot is approximately equal to a half wavelength at 2.45 GHz, and wherein the second length of the second slot is approximately equal to a half wavelength at 5.5 GHz.

5. The apparatus of claim 1, wherein the structure is elongated along a first axis, and wherein at least one of the first slot or the second slot is slanted with respect to the first axis at between a 20-degree and a 70-degree angle.

6. The apparatus of claim 1, wherein the first slot comprises:

a first portion that intersects with the second slot;

a second portion that forms a first end at a second angle with respect to the first portion; and a third portion that forms a second end at the second angle with respect to the first portion and that is parallel to the second portion.

7. The apparatus of claim 1, wherein the structure further comprises:

a second member disposed a first distance away from the first member; and a third member and a fourth member, both connected to the first member and the second member to define a chamber within the structure.

8. The apparatus of claim 7, wherein the first distance is between 8 and 20 millimeters.

9. The apparatus of claim 1, wherein the first slot and the second slot intersect at an intersection location of the first member, the apparatus further comprising:

a circuit board;

a radio disposed on the circuit board and coupled to the RF feed;

a balun disposed on the circuit board and coupled to the RF feed, wherein the balun comprises a first conductor and a second conductor;

a first pressure contact coupled to the first conductor, the first pressure contact positioned on an edge of the circuit board and in physical contact with the first member at a first side of the intersection location; and a second pressure contact coupled to the second conductor, the second pressure contact positioned on the edge of the circuit board at a location that is approximately four to six millimeters from the first pressure contact and in physical contact with the first member at a second side of the intersection location.

10. An electronic device comprising:

a circuit board;

a radio disposed on the circuit board;

an antenna assembly coupled to the radio and comprising a plurality of structures, wherein a first structure of the plurality of structures comprises a first member including a plurality of slots, the plurality of slots comprising:

a first slot having a first width and a first length; and a second slot having a second width and a second length, wherein the second width is between 1.2 and 1.6 times greater than the first width, and wherein the second slot intersects the first slot at an angle with respect to the first slot that is between 70 and 110 degrees;

wherein in response to signals from the radio, the first slot is to radiate electromagnetic energy in a first frequency range and the second slot is to radiate electromagnetic energy in a second frequency range.

11. The electronic device of claim 10, wherein the radio comprises a wireless local area network (WLAN) radio, the electronic device further comprising a wireless personal area network (WPAN) radio disposed on the circuit board;

an antenna carrier attached to antenna assembly; and a patch antenna disposed on the antenna carrier and that is coupled to the WPAN radio, wherein the patch antenna, in response to signals from the WPAN radio, is to radiate electromagnetic energy in a third frequency range that overlaps, at least in part, with the first frequency range.

12. The electronic device of claim 10, wherein the plurality of structures are interconnected such as to define an inner cavity bounded by the plurality of structures, the circuit board disposed in the inner cavity, the electronic device further comprising:

a second member disposed a first distance away from the first member, wherein the second member partially bounds the inner cavity; and a third member and a fourth member, both connected to the first member and the second member to define a chamber, wherein a height of the chamber is between 20 and 60 millimeters longer than the first length of the first slot.

13. The electronic device of claim 12, wherein the first structure is elongated within a first plane and the circuit board is oriented in a second plane that is perpendicular to the first plane, the electronic device further comprising a heat spreader attached to a top of the circuit board, the heat spreader comprising a flange aligned parallel to the first plane and attached to the second member.

14. The electronic device of claim 12, wherein the first slot and the second slot intersect at an intersection location, wherein the circuit board further comprises:

a transmission line of the radio;

a first contact pad extending through an opening in the second member;

a balun disposed on the first contact pad and coupled to the transmission line, wherein the balun includes a first conductor and a second conductor;

a first pressure contact coupled to the first conductor, the first pressure contact positioned on an edge of the first contact pad and in physical contact with the first member at a first side of the intersection location; and a second pressure contact coupled to the second conductor, the second pressure contact positioned on the edge of the first contact pad at a location distanced from the first pressure contact and in physical contact with the first member at a second side of the intersection location.

15. The electronic device of claim 12, wherein the first distance comprises between approximately 8 and 20 millimeters.

16. The electronic device of claim 10, wherein the first structure is elongated along a first axis, and wherein each of the first slot and the second slot is slanted with respect to the first axis at between a 20-degree and a 70-degree angle.

17. An apparatus comprising:

a radio frequency (RF) feed; and a structure made of metal and coupled to the RF feed, wherein the structure comprises:

a first member defining a plurality of slots, the plurality of slots comprising:

a first slot having a first width and a first length; and a second slot having a second width and a second length, wherein the second width is between 1.2 and 1.6 times greater than the first width, and wherein the second slot intersects the first slot at an angle with respect to the first slot that is between 70 and 110 degrees;

a second member disposed a first distance away from the first member; and a third member and a fourth member, both connected to the first member and the second member to define a chamber within the structure.

18. The apparatus of claim 17, wherein the first slot comprises:

a first portion that intersects with the second slot;

a second portion that forms a first end at a second angle with respect to the first portion; and a third portion that forms a second end at the second angle with respect to the first portion and that is parallel to the second portion.

19. The apparatus of claim 17, further comprising:

a circuit board;

a wireless local area network (WLAN) radio disposed on the circuit board and coupled to the RF feed, wherein in response to signals from the WLAN radio, the first slot is to radiate electromagnetic energy in a first frequency range and the second slot is to radiate electromagnetic energy in a second frequency range;

a wireless personal area network (WPAN) radio disposed on the circuit board;

an antenna carrier attached to the structure; and a patch antenna disposed on the antenna carrier and coupled to the WPAN radio, wherein the patch antenna, in response to signals from the WPAN radio, is to radiate electromagnetic energy in a third frequency range that overlaps, at least in part, with the first frequency range.

* * * * *